US010431363B2

(12) United States Patent
Connell

(10) Patent No.: US 10,431,363 B2
(45) Date of Patent: Oct. 1, 2019

(54) PLUNGER FOR MAGNETIC LATCHING SOLENOID ACTUATOR

(71) Applicant: JOHNSON ELECTRIC INTERNATIONAL AG

(72) Inventor: Richard Anthony Connell, Cambridge (GB)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 0 days.

(21) Appl. No.: 15/449,335

(22) Filed: Mar. 3, 2017

(65) Prior Publication Data

US 2017/0256349 A1 Sep. 7, 2017

(30) Foreign Application Priority Data

Mar. 4, 2016 (GB) ..... 1603792.1

(51) Int. Cl.
*H01F 7/00* (2006.01)
*H01F 7/16* (2006.01)
*H01F 7/121* (2006.01)

(52) U.S. Cl.
CPC ..... *H01F 7/1615* (2013.01); *H01F 7/121* (2013.01)

(58) Field of Classification Search
CPC ..... H01F 7/16; H01F 7/121
USPC ..... 335/229
See application file for complete search history.

(56) References Cited

U.S. PATENT DOCUMENTS 3,989,066 A * 11/1976 Sturman ..... A01G 25/162 137/624.2
4,518,939 A 5/1985 Read et al.
5,313,161 A 5/1994 Miyazawa et al.
5,362,209 A * 11/1994 Day ..... F02D 1/08 123/357
6,040,752 A * 3/2000 Fisher ..... H01F 7/1615 335/229
6,392,516 B1 5/2002 Ward et al.
8,957,748 B2 * 2/2015 Tomimbang ..... H01H 50/32 335/127
2004/0140192 A1 7/2004 Sung et al.
2005/0052265 A1 * 3/2005 Vladimirescu ..... H01F 7/1615 335/229

(Continued)

FOREIGN PATENT DOCUMENTS

CN 103325519 A 9/2013
CN 104821258 A 8/2015

(Continued)

OTHER PUBLICATIONS

Intellectual Property Office of the United Kingdom of Great Britain and Northern Ireland, Examination Report, dated Feb. 22, 2019, 5 pages.

*Primary Examiner* — Shawki S Ismail
*Assistant Examiner* — Lisa N Homza
(74) *Attorney, Agent, or Firm* — Muncy, Geissler, Olds & Lowe, P.C.

(57) ABSTRACT

A plunger includes an elongate plunger body which is at least in part cylindrical and a plunger head at one end of the plunger body. The plunger body has a magnet-interface body portion which has a non-cylindrical cross-section perpendicular to a longitudinal axis of the plunger body. A magnetic latching solenoid actuator using such a plunger is also provided, as is a method of improving the performance of a magnetic latching solenoid actuator.

18 Claims, 7 Drawing Sheets

(56) References Cited

U.S. PATENT DOCUMENTS

| | | | | |
|---|---|---|---|---|
| 2007/0120633 | A1 | 5/2007 | Sakurai et al. | |
| 2010/0127807 | A1* | 5/2010 | Hammond | H01F 7/1615 335/255 |
| 2013/0241680 | A1* | 9/2013 | Hanchett, Jr. | H01F 7/1615 335/234 |
| 2015/0213987 | A1 | 7/2015 | Sasaki et al. | |
| 2016/0010611 | A1* | 1/2016 | Singh | F02M 51/0617 251/129.15 |
| 2016/0123289 | A1* | 5/2016 | Schuerg | F02M 63/0036 239/585.1 |

FOREIGN PATENT DOCUMENTS

| | | | |
|---|---|---|---|
| EP | 1225609 | A2 | 7/2002 |
| GB | 548717 | A | 10/1942 |
| GB | 2099223 | A | 12/1982 |
| JP | 2006222438 | A | 3/2005 |
| JP | 2006286356 | A | 3/2005 |

* cited by examiner

PLUNGER FOR MAGNETIC LATCHING SOLENOID ACTUATOR

CROSS REFERENCE TO RELATED APPLICATIONS

This non-provisional patent application claims priority under 35 U.S.C. § 119(a) from Patent Application No. 1603792.1 filed in Britain on 4 Mar. 2016.

FIELD OF THE INVENTION

The present invention relates to a plunger for use with a magnetic latching solenoid actuator, and in particular but not necessarily exclusively for switching contactor actuator arrangements. The invention further relates to a magnetic latching solenoid actuator, and also to improving the performance of a magnetic latching solenoid actuator.

BACKGROUND OF THE INVENTION

In order to increase the cost-effectiveness of production of solenoid actuators, in many cases, a magnet element of the actuator has utilised traditional ferrite magnets in lieu of the more powerful rare earth magnets. Given the scarcity of rare earth elements, the cost of producing magnetic products using such magnets is increasing.

The weaker magnetic field of a ferrite magnet when compared with a rare earth magnet does, however, pose problems for the construction of actuators. Reducing the magnetic strength of the magnets in turn reduces the applicable force on the plunger of an actuator, which reduces the magnetic hold and coil drive across the entire stroke of the plunger. This can have deleterious effects for applications where a strong and consistent stroke is required in order to have any specific effect.

Actuators for switching contactor arrangements are one such area in which the stroke force is critical, since a weaker stroke force can lead to electrical arcing between contacts and/or contact bounce, either of which can damage the switching contactor and cause faults over time.

SUMMARY OF THE INVENTION

The present invention seeks to provide an improved plunger arrangement so as to obviate or limit the above-mentioned problems.

According to a first aspect of the invention, there is provided a plunger for a magnetic latching solenoid actuator, the plunger comprising: an elongate plunger body; and a plunger head at one end of the plunger body; the plunger body having a magnet-interface body portion which defines first and second planar surfaces on opposite lateral sides of the plunger body.

Plungers for magnetic solenoid actuators typically have a round cross-section so as to provide minimal frictional engagement between the plunger and solenoid. By providing planar portions of the plunger body which are arranged to magnetically link with the latching magnets of the actuator, the free motion of the plunger into the solenoid is not inhibited, whilst the latching engagement between the plunger and latching magnets is significantly improved. This improves the effectiveness of the actuator, particularly where weaker magnets, and typically more cost-effective, magnets are provided.

Preferably, the magnet-interface body portion may have a square or rectangular said cross-section.

Square, cuboidal or largely rectangular magnet-interface body portions can advantageously improve the magnetic linkage between the plunger and the latching magnets. Since the latching magnets will typically have planar surfaces, the provision of a planar surface on the plunger ensures that a uniform or substantially uniform magnetic interaction is created, strengthening the magnetic interaction therebetween.

The magnet-interface body portion may be spaced from the plunger head, and/or spaced from an end of the plunger body which is opposite the plunger head.

By positioning the magnet-interface body portion away from the ends of the plunger body, the minimum amount of extra material may be used in the manufacture of the plunger. Evidently, a cylindrical plunger requires a reduced amount of magnetically-attractable material to form the plunger body for a given length, when compared with a square profiled plunger having a width equal to the cylinder diameter. Minimising the increase in the weight of the plunger also results in a greater accelerating force provided by the actuator for a given applied voltage.

The plunger body may be at least in part cylindrical adjacent to the magnet-interface body portion.

The provision of at least a cylindrical tail to the plunger allows the plunger to be used with a cylindrical solenoid coil, which is the more generally used form of solenoid coil in an actuator.

Optionally, the magnet-interface body portion may have a greater cross-sectional area than that of the plunger body.

Having a greater cross-sectional area of plunger in the magnet-interface body portion ensures that the plunger can freely move with respect to the solenoid coil without colliding with objects adjacent to the actuator.

The magnet-interface body portion may extend along at least a majority of a longitudinal extent of the plunger body, and may, in one embodiment, extend along the entire longitudinal extent thereof. The magnet-interface body portion may preferably have a uniform or substantially uniform width along the longitudinal extent of the plunger body.

A plunger having a fully square or rectangular cross-section along its length may be simpler to manufacture than an equivalent plunger having a mixture of square and cylindrical body portions, and can be used with a solenoid coil having square windings.

According to a second aspect of the invention, there is provided a magnetic latching solenoid actuator comprising: a solenoid coil; a magnetisable solenoid core mounted within the solenoid coil; a magnet element mounted at or adjacent to an end of the solenoid coil; and a plunger, preferably in accordance with the first aspect of the invention, having a magnet-interface body portion magnetically engagable with the magnet element, the plunger being receivable by the solenoid coil such that at least part of the magnet-interface body portion is adjacent to the magnet element, the magnet-interface body portion being complementarily-shaped to the magnet element to increase or optimise a magnetic engagement therebetween.

A magnetic latching solenoid actuator having a plunger with a complementary shape to the magnet element will have an improved magnetic linkage between the plunger and magnet element, resulting in a greater stroke force on actuation, and a resulting more powerful actuator for a given drive voltage.

An extent of the plunger which is receivable within the solenoid coil may be cylindrical, whilst the solenoid coil itself may also be cylindrical. The magnet-interface body portion of the plunger may be sized so as to be unable to enter the solenoid coil. The magnet-interface body portion of the plunger may have a square or rectangular cross-section. As an alternative, the magnet-interface body portion may form at least a majority of the longitudinal extent of the body of the plunger, the magnet-interface body portion having a square or rectangular cross-section. A solenoid coil for such a plunger may be a square or rectangular coil. Optionally, the solenoid core may form or include a plunger stop.

The entry of the plunger into the solenoid coil of the actuator can be limited in order to prevent accidental damage to the coil by the magnet-interface body portion of the plunger. There are various ways in which this can be achieved.

Preferably, the magnet element may comprise first and second bar magnets, which may be formed as ferrite magnets. In a preferred embodiment, the magnet element may be formed as a magnet housing having a square bore therethrough which is dimensioned to accommodate the magnet-interface body portion of the plunger.

The improved latching force of the actuator means that, if desired, the manufacturer is able to utilise ferrite magnets, rather than the more expensive rare earth magnets, without significant efficiency losses for the actuator. This beneficially improves the cost-effectiveness of such actuators. Furthermore, by using ferrite magnets, which provide a weaker latch, a less powerful solenoid may also be provided, which may improve the cost-effectiveness of manufacture of the actuator.

Preferably, the magnetic latching solenoid actuator may be a contactor switch actuator.

Since contactor switches rely on powerful actuators to limit or minimise the amount of contact bounce, it follows that the improvements to the stroke force provided by the present actuator arrangement would be highly beneficial for such switches.

According to a third aspect of the invention, there is provided a method of improving the performance of a magnetic latching solenoid actuator, the method comprising the step of improving a magnetic interaction between a plunger and a magnet element of the magnetic latching solenoid actuator by modifying a cross-section of the plunger at or adjacent to the magnet element so as to be more square or rectangular so as to better match a shape of the magnet element.

Improving the magnetic interaction between a plunger and the latching magnets of a magnetic latching solenoid actuator beneficially improves the stroke force of the actuator, resulting in more effective and accurate motions of the plunger to be achieved.

BRIEF DESCRIPTION OF THE DRAWINGS

In order to more clearly describe the technical solutions in the prior art or the embodiments of the present invention, the accompanying drawings to be used in the descriptions of the prior art or the embodiments are briefly introduced as follows. Obviously, the following accompanying drawings just illustrate some embodiments of the present invention, and people skilled in the art can obtain other drawings from these drawings without paying creative efforts.

DETAILED DESCRIPTION OF THE PREFERRED EMBODIMENTS

The technical solutions of the embodiments of the present invention will be clearly and completely described as follows with reference to the accompanying drawings. Apparently, the embodiments as described below are merely part of, rather than all, embodiments of the present invention. Based on the embodiments of the present disclosure, any other embodiment obtained by a person skilled in the art without paying any creative effort shall fall within the protection scope of the present invention.

Figure 1:
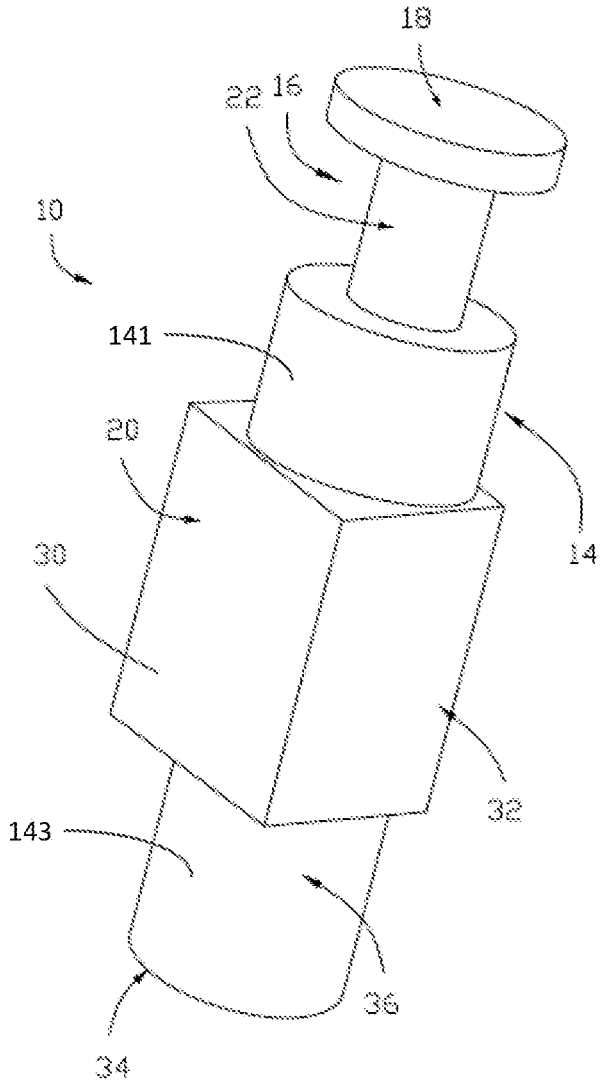
FIG. 1 shows a perspective representation of a first embodiment of a plunger, in accordance with the first aspect of the invention, for use with a magnetic latching solenoid actuator.

Referring firstly to FIG. 1, there is provided a plunger for a magnetic latching solenoid actuator, the plunger being indicated globally by 10. Such a plunger 10 provides an improved performance of a magnetic latching solenoid actuator, such as that indicated generally in FIGS. 2*a* to 3, and referenced generally as 12.

The plunger 10 comprises an elongate, preferably predominantly cylindrical, plunger body 14, which has at one end 16 a plunger head 18 which is capable of transferring a force generated by any magnetic latching solenoid actuator 12 into which the plunger 10 is incorporated to another device. For example, the magnetic latching solenoid actuator 12 could be used as an actuator in a switching contactor arrangement.

The plunger 10 illustrated has a substantially uniform lateral or radial extent of the plunger body 14 and plunger head 18, with the exception of a magnet-interface body portion 20 of the plunger body 14 which will be discussed in more detail below. The plunger 10 in this instance also includes a plunger neck 22 which separates the plunger body 14 from the plunger head 18, though the form of the plunger head 18 will be dependent upon the exact usage of the magnetic latching solenoid actuator 12, and the dimensions of the plunger body 14 will be dependent upon the inner dimensions of a solenoid coil 24 of the magnetic latching solenoid actuator 12.

The plunger body 14 further comprises a first portion 141 and a second portion 143 having a same cross-section as a cross-section of the first portion 141. The magnet-interface body portion 20 of the body portion 14 is between the first portion 141 of the plunger body and the second portion 143 of the plunger body 14. The magnet-interface body portion 20 is formed so as to improve a magnetic interaction between a magnet element 26 of the magnetic latching solenoid actuator 12 with which the plunger 10 will be used. This can be achieved by modifying a cross-section of the plunger body 14 so as to form the magnet-interface body portion 20 such that there is a uniform or substantially uniform separation thereof from one or more latching magnets 28 of the magnet element 26.

In the depicted embodiment, the magnet-interface body portion 20 is formed as a cuboidal or substantially cuboidal block which projects at least in part away from the cylindrical plunger body 14 in a direction perpendicular to the longitudinal axis of the plunger 10. This presents at least first and second opposite planar surfaces 30, 32 which are positioned on opposite lateral sides of the plunger body 14. Whilst the cuboid form of the magnet-interface body portion 20 will, as in the depicted embodiment, form four such planar surfaces, it will be appreciated that for the majority of magnetic latching solenoid actuators 12, there will be two opposed planar magnets 28 at one end of the solenoid coil 24, and therefore a reasonable magnetic interaction between the plunger 10 and the magnets 28 is achievable merely by the provision of two such surfaces 30, 32.

The magnet-interface body portion 20 is itself here spaced apart from both the plunger head 18 and an end 34 of the plunger body 14 which is opposite the plunger head 18. An end portion 36 of the plunger body 14 which is distal to the plunger head 18 here has a cylindrical or substantially cylindrical form, and is dimensioned so as to be receivable within the solenoid coil 24. By contrast, the magnet-interface body portion 20 may be dimensioned such that it is unable to fit into the solenoid coil 24. This may be achieved by the cuboidal block of the magnet-interface body portion being wider than the area within the solenoid coil 24.

Figure 2A:
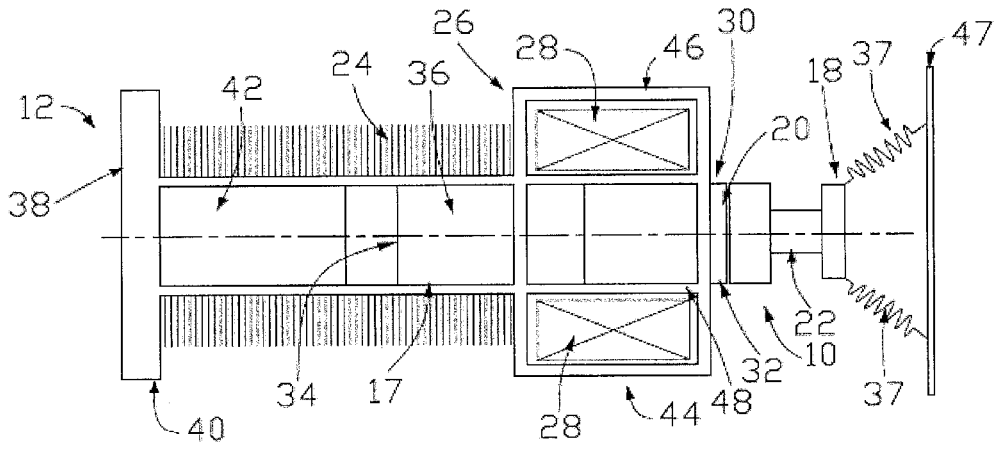
FIG. 2*a* shows a side-on sectional representation of a first embodiment of a magnetic latching solenoid actuator in accordance with the second aspect of the invention, utilising the plunger of FIG. 1, which is in an extended condition relative to the solenoid core.
Figure 2B:
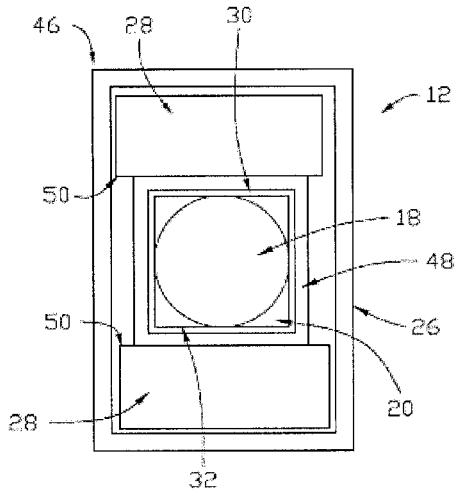
FIG. 2*b* shows an end-on representation of the magnetic latching solenoid actuator of FIG. 2*a;*
Figure 3:
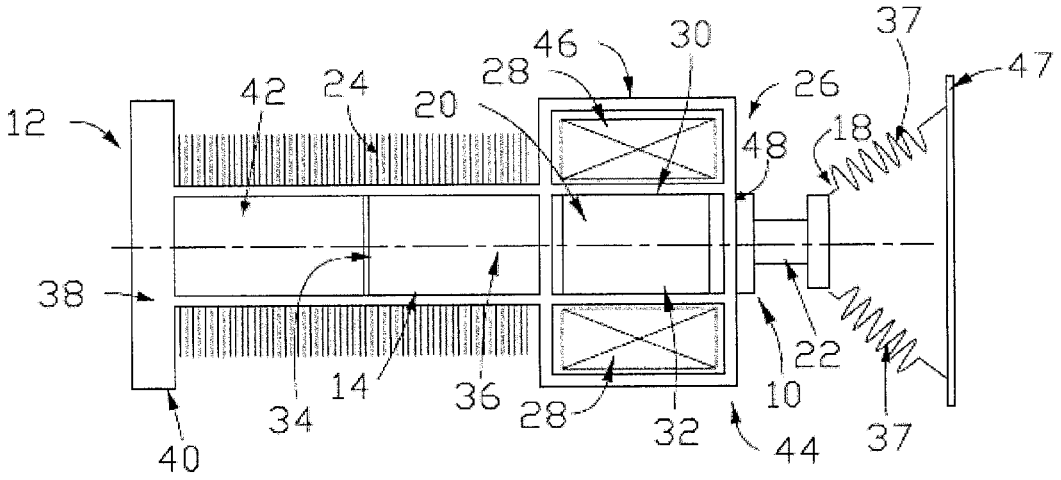
FIG. 3 shows a side-on sectional representation of the magnetic latching solenoid actuator of FIG. 2*a*, the plunger being in a retracted condition relative to the solenoid core.

A typical magnetic latching solenoid actuator 12 is illustrated in FIGS. 2*a* to 3. FIG. 2*a* shows the magnetic latching solenoid actuator 12 having an extended plunger 10 in cross-section, with FIG. 2*b* showing the same when viewed from one end, in this case, from the right-hand-side of FIG. 2*a*. Since, in a magnetic latching solenoid actuator 12, the solenoid coil 24 would be de-energised other than when required to actuate the plunger 10 between extended and retracted conditions, there would typically be one or more biasing springs 37 attached to the plunger 10 in order to assist with maintaining the plunger 10 position in its extended condition.

The magnetic latching solenoid actuator 12 as shown comprises the solenoid coil 24 having a baseplate 38 at one end 40 thereof, which is external to the solenoid coil 24, to which is attached the magnetisable solenoid core 42 positioned inside the solenoid coil 24. This solenoid core 42 typically forms the plunger stop of the solenoid, around which the solenoid coil 24 is wound.

At an opposite end 44 of the solenoid coil 24, the magnet element 26 is positioned, which is here formed as a magnet housing 46 having a square bore 48 therethrough. Housed therein are two, preferably ferrite, bar magnets 28 which are spaced on opposite sides of the bore 48 within the magnet housing 46.

The plunger 10 is then inserted into the magnetic latching solenoid actuator 12 such that at least part of the end portion 36 is inside the solenoid coil 24, with the magnet-interface body portion 20 of the plunger body 14 being at or adjacent to the magnet element 26.

In FIG. 2*a*, the magnetic latching solenoid actuator 12 is not energised, and the plunger 10 is in an extended position. The biasing springs 37 may be engaged with the plunger 10 so as to ensure that the plunger position is maintained in a de-energised state of the magnetic latching solenoid actuator 12, with respect to an actuator housing, represented by housing wall 47 in FIGS. 2*a* and 3.

In this default condition, a majority of the magnet-interface body portion 20 of the plunger 10 overlaps with the magnets 28 of the magnet element 26. However, the entirety of the magnet-interface body portion 20 does not overlap. This can be readily seen in FIG. 2*a*.

FIG. 2*b* shows the same magnetic latching solenoid actuator 12 from its end. This illustrates the proximity between the first and second planar surfaces 30, 32 of the magnet-interface body portion 20; the first and second planar surfaces 30, 32 are parallel to and in close proximity to adjacent planar surfaces 50 of the magnets 28 of the magnet element 26.

This alignment and closeness between the first and second planar surfaces 30, 32 and the adjacent planar surfaces 50 of the magnets 28 ensures a strong and highly uniform magnetic linkage or interaction between the plunger 10 and magnet element 26.

A retracted state of the plunger 10 of the magnetic latching solenoid actuator 12 can be seen in FIG. 3, which follows energisation of the solenoid coil 24 so as to move the plunger 10 from its extended condition. As the solenoid coil 24 is energised, the plunger 10 is retracted into the solenoid coil 24, with the magnet-interface body portion 20 substantially aligning between the two magnets 28 of the magnet element 26, creating a significantly increased force of attraction compared with an equivalent completely cylindrical plunger 10. This in turn increases the stroke force applied to whatever is engaged with the plunger head 18. The latching of the plunger 10 to the magnet element 26 is sufficient to overcome the biasing spring 37 force, and therefore the retracted condition of the plunger 10 can be maintained even when the solenoid coil 24 is subsequently de-energised.

As a result of the increased attractive force, not only will the stroke force of the plunger 10 be increased, but the velocity of the plunger 10 in motion will also be significantly increased, which can result in a more effective magnetic latching solenoid actuator, particularly for cases where rapid plunger motion is required.

In tests on the plunger arrangement, it has been found that the increased attractive force realised by the particular arrangement of solenoid significantly outweighs the slight increase in weight of the plunger 10. The reason for this can be visualised in FIGS. 4*a* and 4*b*.

Figure 4A:
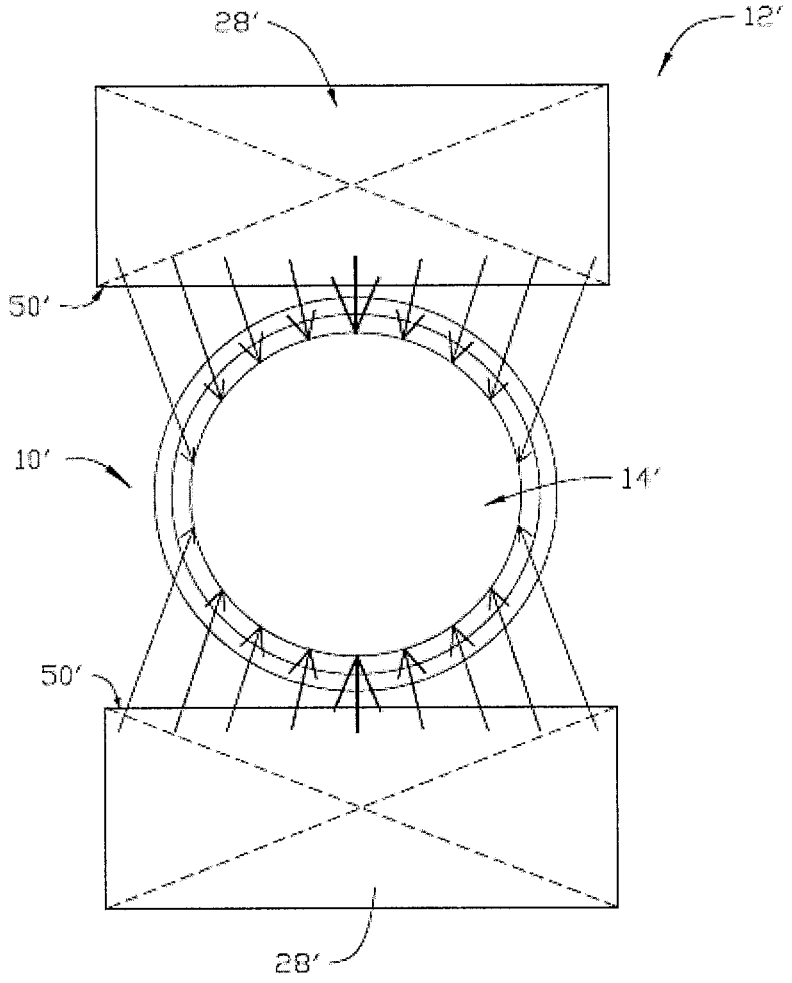
FIG. 4a (Prior Art)
FIG. 4*a* shows an end-on representation of a magnetic latching solenoid actuator having a cylindrical plunger, in accordance with the state of the art, the arrows indicating the magnitude of a magnetic interaction between the magnet element of the actuator and the plunger.

FIG. 4*a* shows a cylindrical plunger 10' in accordance with the prior art, shown as part of a magnetic latching solenoid actuator 12' having first and second bar magnets 28'.

Close to a centre of each of the magnets 28', the edge of the plunger body 14' is in relatively close proximity to the adjacent planar surfaces 50' of the magnets 28'. The magnitude of the magnetic engagement between the magnets 28' and the plunger body 14' at this point will be relatively high;

the strength of the interaction will be proportional to the separation between the adjacent surfaces 50' of the magnets 28' and the plunger body 14'. However, at the edges of the magnets 28', the plunger body 14' is much further from the adjacent surfaces 50' of the magnets 28', and the magnetic interaction is accordingly diminished.

Figure 4B:
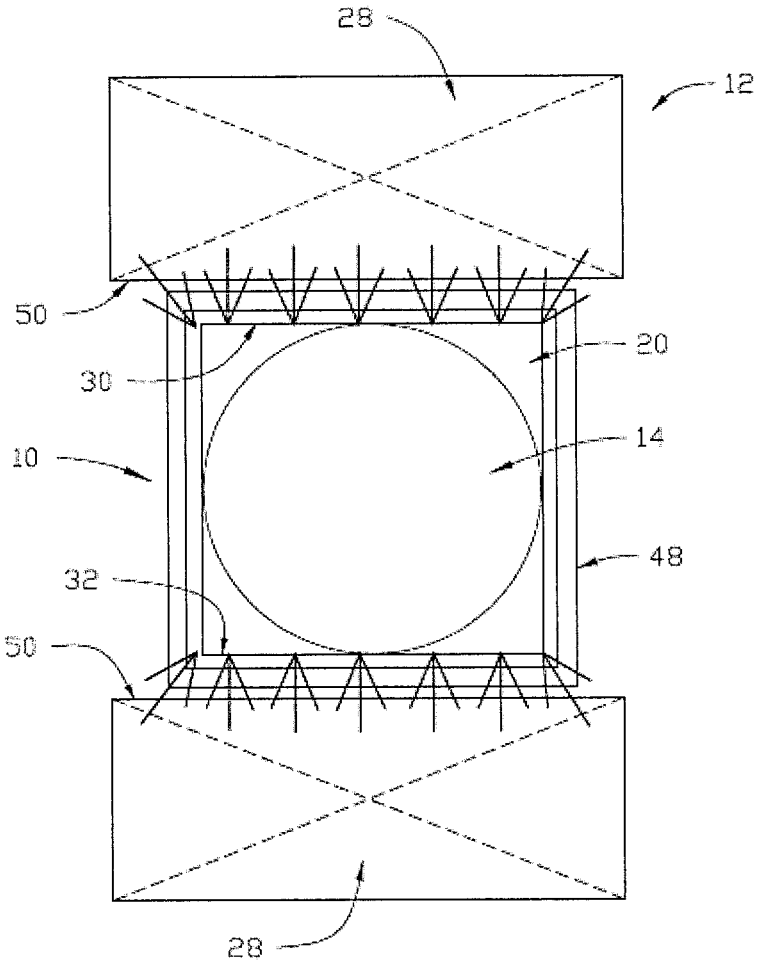
FIG. 4*b* shows an end-on representation of the magnetic latching solenoid actuator of FIG. 2*a*, the arrows indicating the magnitude of a magnetic interaction between the magnet element of the actuator and the plunger.

In the present arrangement, as shown in FIG. 4*b*, the first and second planar surfaces 30, 32 of the magnet-interface body portion 20 extend in parallel, or substantially in parallel to, the adjacent surfaces 50 of the magnets 28 of the magnet element 26 of the actuator 12. As such, the cumulative magnetic interaction across the magnetic-interface body portion 14 is much larger than for the cylindrical plunger 10', since the magnetic force is largely uniform across the width of the magnet-interface body portion 14.

Figure 5:
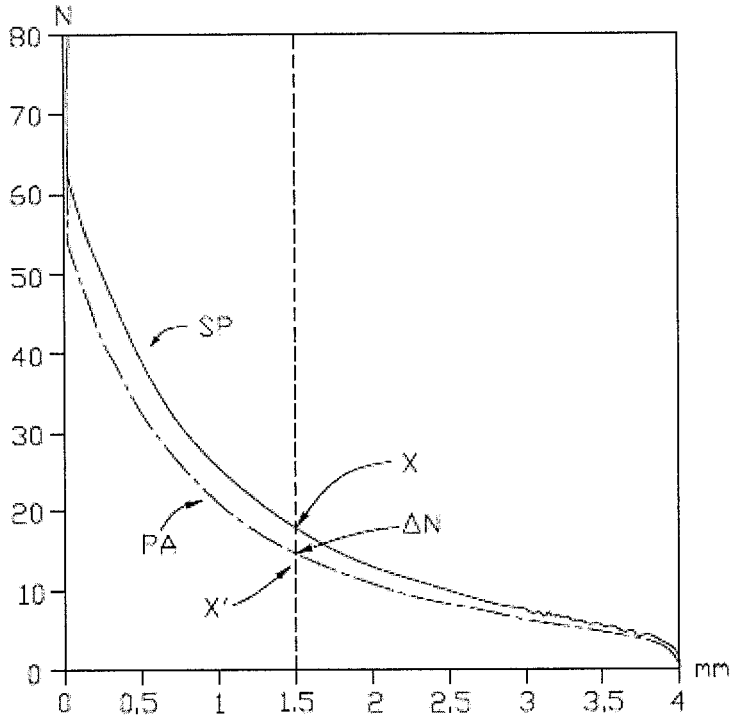
FIG. 5 shows a graph of force applied by the plunger at different plunger extensions, lower curve PA showing the force of the prior-art plunger shown in FIG. 4*a*, and upper curve SP showing the force of the plunger in accordance with the invention and shown in FIG. 4*b;*

This effect can be visualised in FIG. 5, in which the graph of extension distance, in mm, of the plunger 10, 10' for a given magnetic latching solenoid actuator 12, 12' is plotted versus the latching force, in Newtons. A lower curve PA shows a typical force applied by the prior art plunger 10' and the extension achieved, whereas an upper curve SP is shows the force applied to the squared plunger 10 of FIG. 4*b* at various extensions.

As can be seen, the force is consistently greater for the squared plunger 10 when compared with the cylindrical plunger 10' along the vast majority of the extension distance thereof. In particular, the crucial stroke point, which for a switching contactor having a magnetic latching solenoid actuator 12, 12' might be the point at which contacts are engaged or disengaged by the plunger action, is indicative of a critical force requirement. For the present actuator arrangement, it may be that the plunger 10 of the present invention is capable of force improvements of 10% to 20% at the crucial stroke point, this difference being indicated by the difference in force ΔN between the prior art arrangement at a given extension X', which is here an extension of 1.5 mm, and that for the squared plunger 10 at the same extension, indicated at X. The exact extension distance will depend upon the actuator arrangement used, of course.

It can be seen from FIG. 5 that there is a drop-off in the difference between the squared and cylindrical plungers 10, 10' at close to full extension, which is 4.0 mm in the present magnetic latching solenoid actuator configuration. This is due to the magnet-interface body portion 14 exiting the bore 48 of the magnet housing 46, and therefore the magnetic interaction to the plunger 10 being with the cylindrical end portion 36 of the plunger 10.

Figure 6A:
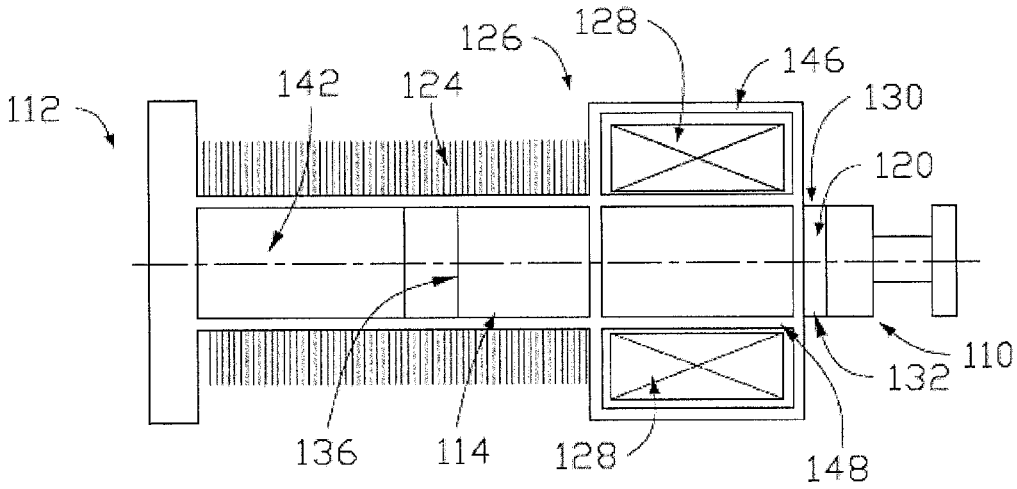
FIG. 6*a* shows a side-on sectional representation of a second embodiment of an embodiment of a magnetic latching solenoid actuator, in accordance with the second aspect of the invention, the plunger being in an extended condition relative to the solenoid core.
Figure 6B:
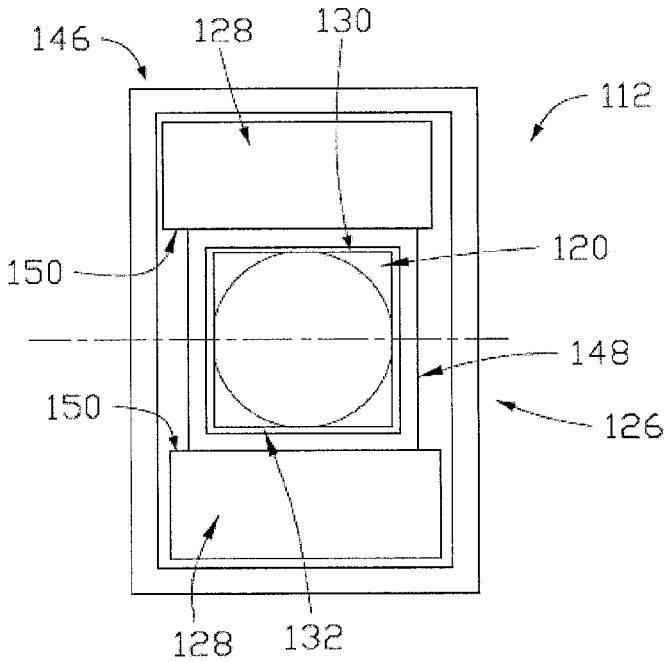
FIG. 6*b* shows an end-on representation of the magnetic latching solenoid actuator of FIG. 6*a.*

This interaction can be improved by extending the length of the magnet-interface body portion, as can be seen in the embodiments shown in FIGS. 6*a* and 6*b*. Identical or similar components in this second embodiment will be referred to using similar or identical reference numerals respectively, and further detailed description will be omitted for brevity.

The magnetic latching solenoid actuator 112 in this embodiment is largely identical to that described above, with the exception being that the solenoid coil 124 must be formed so as to be capable of receiving a non-cylindrical end portion 136 of the plunger 110. In this instance, the windings of the solenoid coil 124 are square or rectangular in form. The solenoid core 142 may be similarly dimensioned.

The bore 148 through the magnet housing 146 remains square or rectangular in cross-section so as to be able to receive the magnet-interface body portion 120 of the plunger body 114, which may extend along a majority, or preferably a total extent as shown, of the plunger body 114 and have a, preferably uniform, square or rectangular profile, so as to present first and second planar faces 130, 132 along the majority of the extent of the plunger body 114.

In this embodiment, at any extension of the plunger 110, the extent of the magnet-interface body portion 120 which is between the magnet 128 of the magnet element 126 remains unchanged. As such, the first and second planar surfaces 130, 132 have a uniform or largely constant separation from the adjacent surfaces 150 of the magnets 128 regardless of the extension distance of the plunger 110.

It will be appreciated that a square or rectangular cross-section of the magnet-interface body portion is not strictly necessary to achieve the close proximity of the plunger to an external face of the magnets of the magnet element of the magnetic latching solenoid actuator. There need only be sufficient correspondence between the two. For instance, the surfaces of the magnets could be shaped so as to match to the plunger shape, or the magnet-interface body portion could have first and second planar surfaces which are interconnected by non-linear outer surfaces. A hexagonal cross-section through the magnet-interface body portion might, for example, be considered without deviating from the present scope of invention. The shape of the magnet-interface body portion therefore may be dictated by ease of manufacture, or similar constraints.

It will also be apparent that whilst an actuator could be provided which omitted the biasing springs, maintaining the plunger position by maintaining energised or de-energised states of its solenoid coil.

It is therefore possible to provide a plunger for a magnetic latching solenoid actuator which has an improved magnetic linkage to the magnet element of the magnetic latching solenoid actuator, thereby improving the stroke force and thus efficiency of the actuator. This is achieved by providing at least partially flat surfaces on the plunger body which will experience a greater magnetic attraction to similarly planar magnets of the actuator.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

All embodiments in the specification are described in a progressive way, each embodiment mainly describes the differences from other embodiments, and the same and similar parts among the embodiments can be referenced mutually.

Although the invention is described with reference to one or more embodiments, the above description of the embodiments is used only to enable people skilled in the art to practice or use the invention. It should be appreciated by those skilled in the art that various modifications are possible without departing from the spirit or scope of the present invention. The embodiments illustrated herein should not be interpreted as limits to the present invention, and the scope of the invention is to be determined by reference to the claims that follow.

The invention claimed is:

1. A plunger for a magnetic latching solenoid actuator, the plunger comprising:

an elongate plunger body; and a plunger head at one end of the plunger body;

a first portion of the plunger body;

a second portion of the plunger body having a same transverse cross-section as a transverse cross-section of the first portion;

a magnet-interface body portion of the body portion between the first portion of the plunger body and the second portion of the plunger body which defines first and second planar surfaces on opposite lateral sides of the plunger body with a different transverse cross-section than the transverse cross-sections of the first and second portions of the plunger body.

2. The plunger as claimed in claim 1, wherein the magnet-interface body portion has a square or rectangular said transverse cross-section.

3. The plunger as claimed in claim 1, wherein the first portion of the plunger body is spaced from the plunger head by a plunger neck.

4. The plunger as claimed in claim 3, wherein the plunger neck has a radial dimension smaller that a radial dimension of the plunger head.

5. The plunger as claimed in claim 1, wherein the first and second portions of the plunger body are at least in part cylindrical adjacent to the magnet-interface body portion.

6. The plunger as claimed in claim 1, wherein the magnet-interface body portion has a greater cross-sectional area than that of a remainder of the plunger body.

7. The plunger as claimed in claim 1, wherein the magnet-interface body portion extends along at least a majority of a longitudinal extent of the plunger body.

8. The plunger as claimed in claim 7, wherein the magnet-interface body portion extends along the entirety of the longitudinal extent of the plunger body.

9. The plunger as claimed in claim 7, wherein the magnet-interface body portion has a uniform or substantially uniform width along the longitudinal extent of the plunger body.

10. A magnetic latching solenoid actuator comprising:

a solenoid coil;

a magnetisable solenoid core mounted within the solenoid coil;

a magnet element mounted at or adjacent to an end of the solenoid coil; and a plunger having a magnet-interface body portion magnetically engagable with the magnet element, the plunger being receivable by the solenoid coil such that at least part of the magnet-interface body portion is adjacent to the magnet element, the magnet-interface body portion being complementarily-shaped to the magnet element to increase or optimise a magnetic engagement therebetween;

wherein the magnet-interface body portion of the plunger is sized so as to be unable to enter the solenoid coil.

11. The magnetic latching solenoid actuator as claimed in claim 10, wherein an extent of the plunger which is receivable within the solenoid coil is cylindrical.

12. The magnetic latching solenoid actuator as claimed in claim 11, wherein the solenoid coil is a cylindrical coil.

13. The magnetic latching solenoid actuator as claimed in claim 10, wherein the magnet-interface body portion of the plunger has a square or rectangular cross-section.

14. The magnetic latching solenoid actuator as claimed in claim 10, wherein the magnet-interface body portion forms at least a majority of a longitudinal extent of a body of the plunger, the magnet-interface body portion having a square or rectangular cross-section.

15. The magnetic latching solenoid actuator as claimed in claim 14, wherein the solenoid coil is a square or rectangular coil.

16. The magnetic latching solenoid actuator as claimed in claim 10, wherein the solenoid core forms a plunger stop.

17. The magnetic latching solenoid actuator as claimed in claim 10, wherein the magnet element comprises first and second bar magnets.

18. The magnetic latching solenoid actuator as claimed in claim 10, wherein the magnet element is formed as a magnet housing having a square bore therethrough which is dimensioned to accommodate the magnet-interface body portion of the plunger.

* * * * *